US011364977B2

(12) United States Patent
Kjorlien et al.

(10) Patent No.: US 11,364,977 B2
(45) Date of Patent: Jun. 21, 2022

(54) BOAT DRIVER AWARENESS LIGHT

(71) Applicants: Ross Allan Kjorlien, Drayton Valley (CA); Leonard Jack Hudzinski, Drayton Valley (CA)

(72) Inventors: Ross Allan Kjorlien, Drayton Valley (CA); Leonard Jack Hudzinski, Drayton Valley (CA)

( * ) Notice: Subject to any disclaimer, the term of this patent is extended or adjusted under 35 U.S.C. 154(b) by 0 days.

(21) Appl. No.: 17/104,657

(22) Filed: Nov. 25, 2020

(65) Prior Publication Data

US 2022/0161906 A1 May 26, 2022

(51) Int. Cl.

| | |
|---|---|
| ***B63B 45/04*** | (2006.01) |
| ***G08B 21/02*** | (2006.01) |
| ***B63C 9/00*** | (2006.01) |
| ***F21W 111/00*** | (2006.01) |
| ***F21Y 115/10*** | (2016.01) |
| ***F21W 107/20*** | (2018.01) |

(52) U.S. Cl.

CPC ..... *B63B 45/04* (2013.01); *B63C 9/0005* (2013.01); *G08B 21/02* (2013.01); *B63B 2201/04* (2013.01); *F21W 2107/20* (2018.01); *F21W 2111/00* (2013.01); *F21Y 2115/10* (2016.08)

(58) Field of Classification Search

CPC ..... B63B 45/04; B63B 45/06; B63B 2201/04; B63C 9/0005; G08B 21/02; F21Y 2115/10; F21W 2107/20; F21W 2111/00

USPC ..... 362/477, 183, 192, 431

See application file for complete search history.

(56) References Cited

U.S. PATENT DOCUMENTS

| | | | | |
|---|---|---|---|---|
| 3,798,631 | A | 3/1974 | Langford | |
| 4,782,784 | A | 11/1988 | Little | |
| 4,807,557 | A | 2/1989 | Lodisio | |
| 5,370,348 | A * | 12/1994 | Toth | B63B 45/04 248/289.11 |
| 5,408,221 | A | 4/1995 | Carsella, Sr. et al. | |
| 5,771,836 | A | 6/1998 | Crouse | |
| 6,499,867 | B1 * | 12/2002 | Neal | B63B 45/02 362/287 |
| 6,962,126 | B1 | 11/2005 | Payson | |
| 7,013,823 | B1 | 3/2006 | Daugherty | |
| 7,546,815 | B2 | 6/2009 | Mazzei et al. | |
| 8,368,560 | B2 | 2/2013 | McDonald | |
| 8,371,730 | B2 * | 2/2013 | Mitchell | F21V 21/088 362/477 |
| 8,577,556 | B1 * | 11/2013 | Noel, II | B60Q 1/18 701/49 |
| 8,997,681 | B2 | 4/2015 | Carr | |
| 9,568,171 | B1 * | 2/2017 | Grider | F21L 4/08 |
| 2013/0039081 | A1 * | 2/2013 | Czipri | B63B 45/04 362/477 |
| 2013/0141901 | A1 * | 6/2013 | Martzall | F21S 8/022 362/183 |
| 2013/0265788 | A1 * | 10/2013 | O'Maley | F21L 4/00 362/477 |

(Continued)

*Primary Examiner* — Laura K Tso

(74) *Attorney, Agent, or Firm* — Stratford Group Ltd.

(57) ABSTRACT

Embodiments of the present invention relate to a boat driver awareness system that alerts other boaters that there are swimmers, skiers, divers, rope or other hazards are in the water, thereby telling them to be aware and take extra caution in the area. When boating, especially on smaller or busy lakes/areas, this system will alert all other boaters that there are people/swimmers in the water and they can respond by keeping out of the area.

5 Claims, 17 Drawing Sheets

(56) References Cited

U.S. PATENT DOCUMENTS

| | | | | |
|---|---|---|---|---|
| 2015/0251735 | A1* | 9/2015 | O'Maley, Jr. ..... | B63B 45/04<br>362/477 |
| 2016/0102815 | A1* | 4/2016 | Bailey ..... | F21V 21/30<br>362/477 |

* cited by examiner

BOAT DRIVER AWARENESS LIGHT

FIELD OF THE INVENTION

The present disclosure relates to boat lights, particularly to boat safety lights, more particularly to boat safety lights that can be activated to alert other boaters that swimmers are in the water.

BACKGROUND

Embodiments of the present invention relate to a boat driver awareness system that alerts other boaters that there are swimmers, skiers, divers, rope or other hazards are in the water, thereby telling them to be aware and take extra caution in the area. When boating, especially on smaller or busy lakes/areas, this system will alert all other boaters that there are people/swimmers in the water and they can respond by keeping out of the area.

BRIEF SUMMARY

It is an object of the invention to provide a boat driver awareness light.

In accordance with an aspect of the invention there is provided a boat safety warning system, comprising: a bracket assembly configured to be affixed to boat; a light assembly comprising a housing, having a translucent section, said housing configured to be attached to said bracket assembly, said housing containing an LED light, and an LED printed circuit board; a power source in electrical connection with said LED light; and a switch which when activated allows power to be supplied from said source to said LED light.

In accordance with another aspect of the invention there is provided a boat safety signaling kit, comprising: a bracket assembly consisting of a bracket, a bracket base plate and attachment means; a light assembly configured to be attached to said bracket assembly, said light assembly consisting of a housing, having a translucent section, an LED light, an LED printed circuit board, and a rechargeable battery in electrical connection with said LED light; and a switch which, when activated, allows power to be supplied from said source to said LED light.

The advantages and features of the present invention will become better understood with reference to the following more detailed description and claims taken in conjunction with the accompanying drawings in which like elements are identified with like symbols.

To easily identify the discussion of any particular element or act, the most significant digit or digits in a reference number refer to the figure number in which that element is first introduced.

BRIEF DESCRIPTION OF THE SEVERAL VIEWS OF THE DRAWINGS

To easily identify the discussion of any particular element or act, the most significant digit or digits in a reference number refer to the figure number in which that element is first introduced.

DETAILED DESCRIPTION

Devices and methods for carrying out the invention are presented in terms of embodiments depicted within the FIGS. However, the invention is not limited to the described embodiments, and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and the configurations shall be shown and described for purposes of clarity and disclosure and not by way of limitation of scope.

Figure 1:
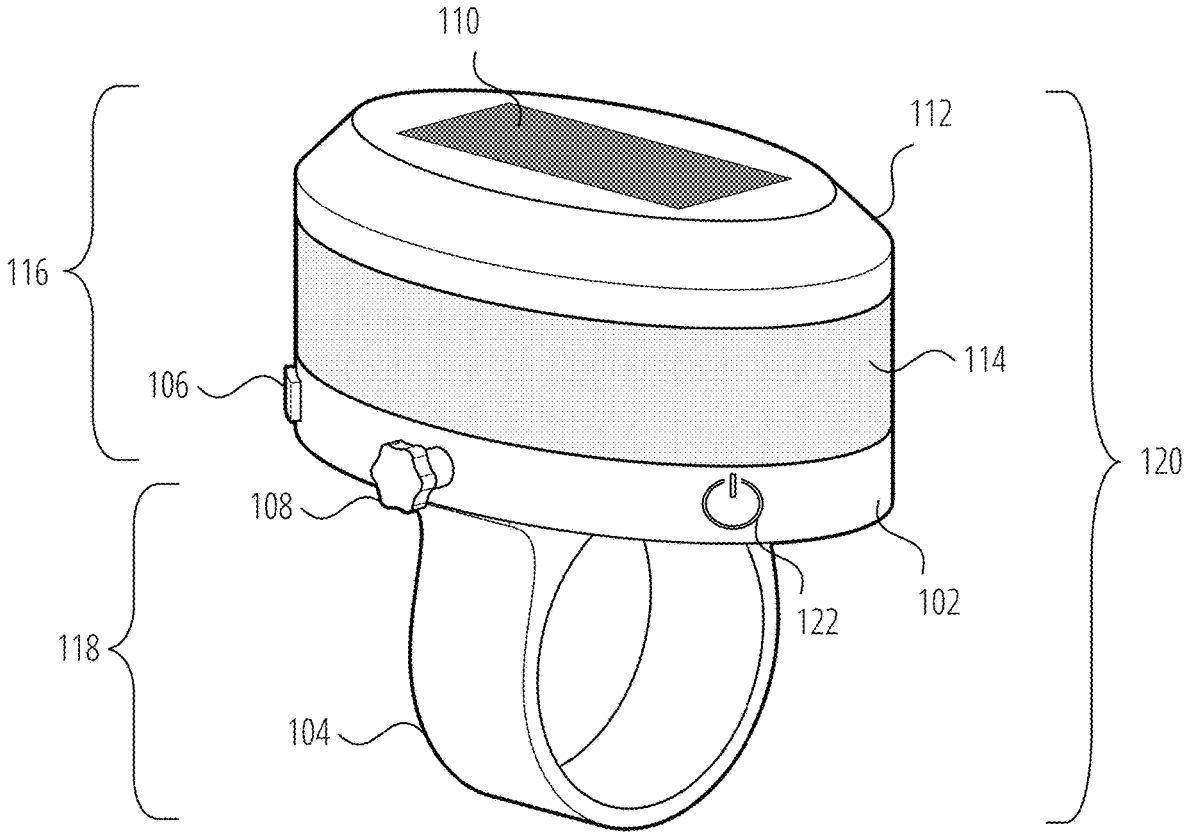
FIG. 1 illustrates a side view of one embodiment of the invention.

FIG. 1 shows a complete light and bracket assembly 120 for mounting onto a pole or tube on a boat. The bracket assembly 118 comprises a bracket 104 that is sized and configured to cooperate with poles or tubes of various diameters. Brackets can be fabricated in numerous sizes; the most common sizes of tubes on many boats being 1.5", 2" and 2.5" diameters. In the illustrated embodiment, the light assembly 116 comprises a light base 102 attached to a translucent housing 114 that supports a trim ring 112. A solar panel 110 can be seem embedded on the top of the light assembly 116. In some embodiments, the bracket assembly 118 may include a rotational member to allow for three dimensional rotation and adjustment.

The light assembly 116 is secured to the bracket assembly 118 by way of a locker screw 108. In certain embodiments of the invention, a charging port 106 may be installed to supplement the power produced by the solar panel 110. In some embodiments of the invention, an optional switch 122 may be present on the light assembly 116.

Figure 2:
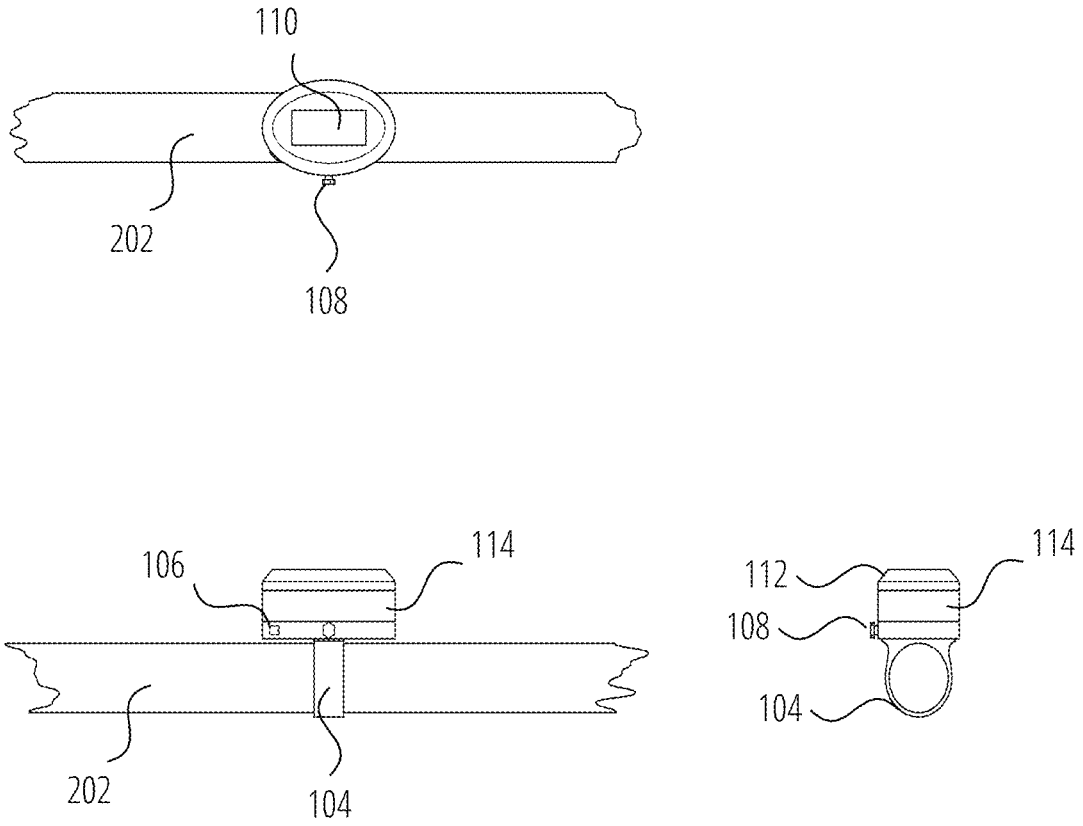
FIG. 2 illustrates top, side and end views of a complete installed embodiment of the invention.

FIG. 2 shows a complete light and bracket assembly 120 mounted onto a partial section of a pole or tube 202. The bracket 104 part of the bracket assembly 118 can be seen encompassing the pole or tube 202. This figure shows the relative positions of the charging port 106, locker screw 108, solar panel 110, trim ring 112, and translucent housing 114 in relation to the pole or tube 202

Figure 3:
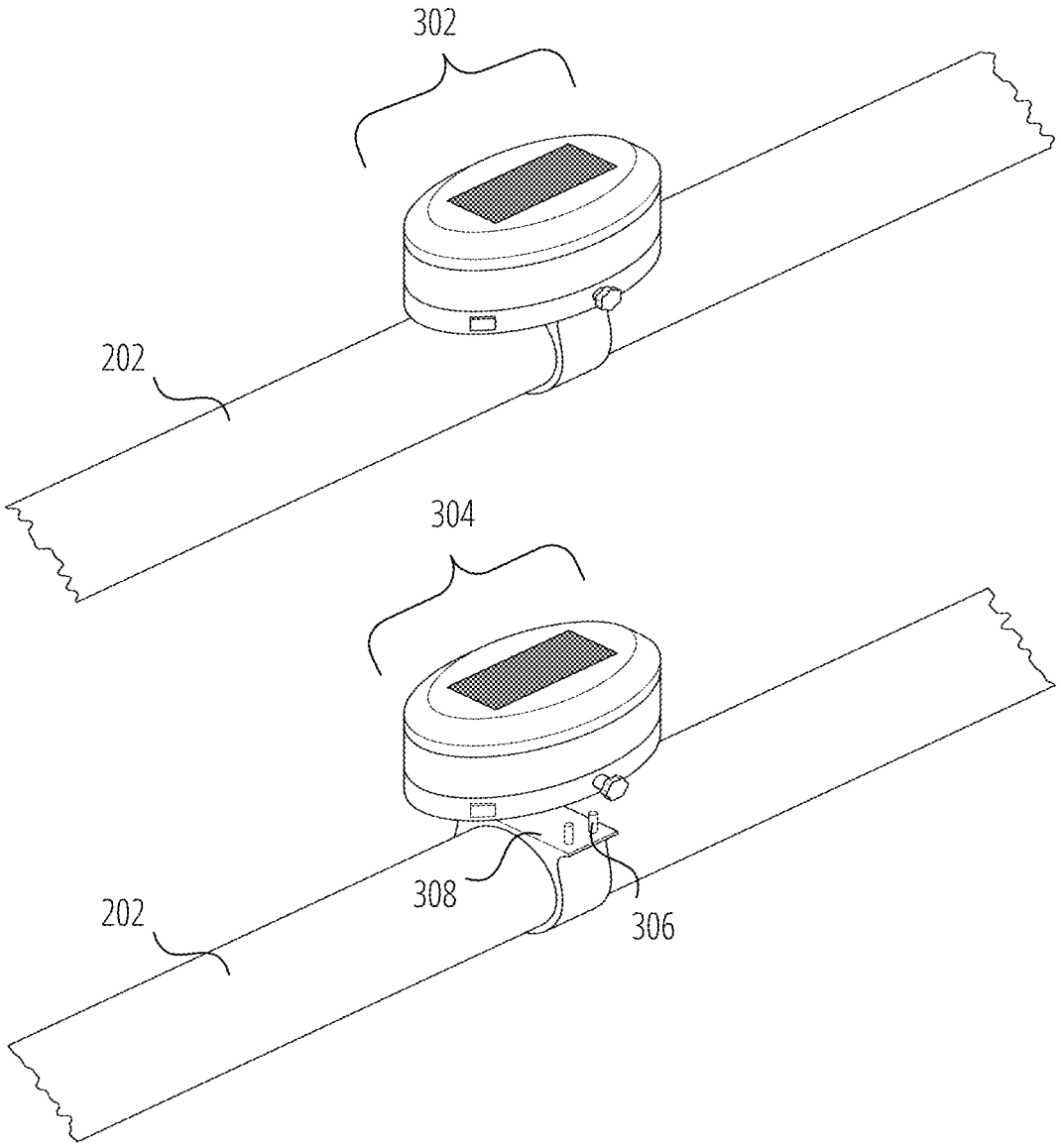
FIG. 3 illustrates a top perspective view showing installation of one embodiment of the invention.

FIG. 3 shows the light assembly 116 in both the attached configuration 302 and in the unattached configuration 304. In the unattached configuration 304, the attachment bolts 306 which connect the bracket base plate 308 118 to the light assembly 116 can clearly be seen.

Figure 4:
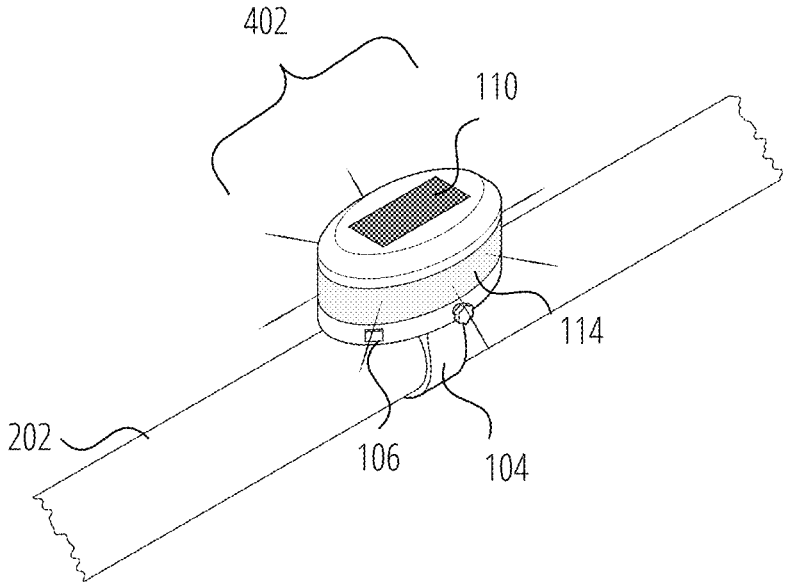
FIG. 4 illustrates a top perspective view showing a functioning installation of one embodiment of the invention.

FIG. 4 shows a complete light and bracket assembly 120 in its activated configuration 402. A light bulb (not shown) is situated within the translucent housing 114 which can be activated to provide light at night or in dim light conditions, or it can be set to flash in emergency or hazardous situations. The light can be activated manually or automatically.

Figure 5:
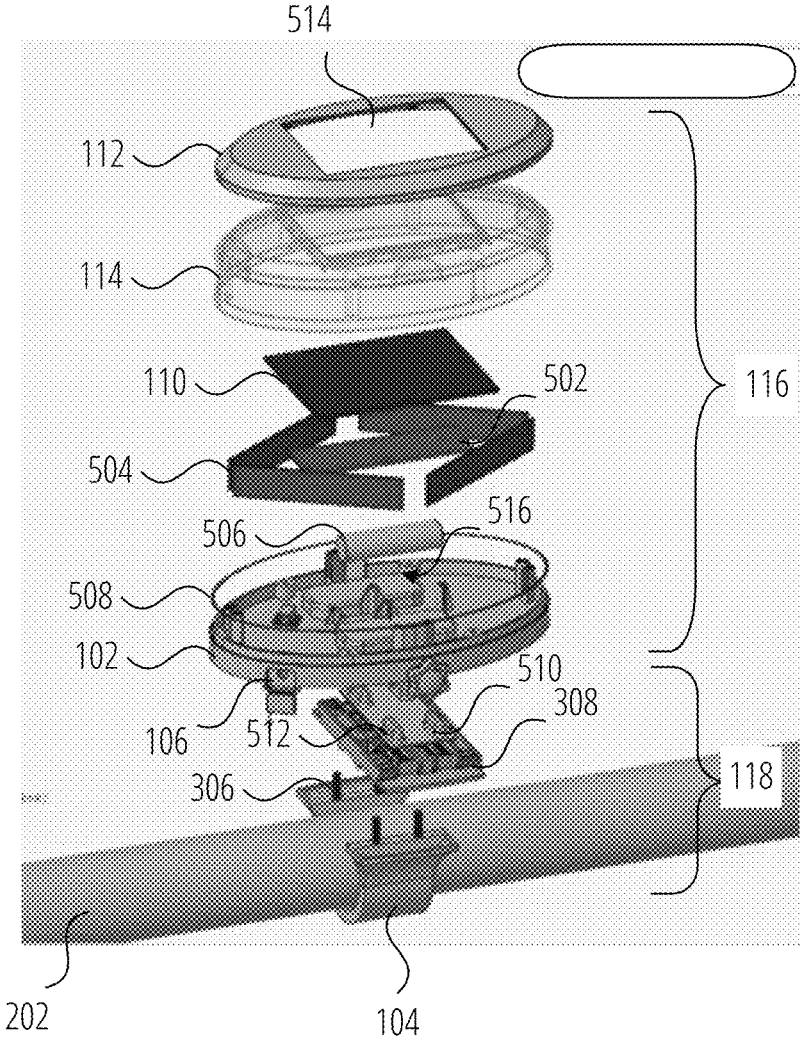
FIG. 5 illustrates an exploded view of one embodiment of the invention.

FIG. 5 illustrates an exploded view of several parts of both the light assembly 116 and the bracket assembly 118 in accordance with one embodiment of the invention.

In the illustrated embodiment, the bracket assembly 118 comprises a bracket 104 having attachment bolts 306 and a bracket base plate 308 that cooperates with the bracket 104 and attachment bolts 306. A plastic cover 510, having indentations 512 configured to cooperate with the attachment bolts 306, can be seen covering the upper part of the bracket base plate 308 and attachment bolts 306.

In the illustrated embodiment, the light assembly 116 comprises a control panel 502, an LED printed control panel (PCB) 504 and a battery 506 situated within the translucent housing 114. An O-ring 508 is seated between the light bases 102 and the translucent housing 114 to seal the unit from moisture.

The solar panel 110, is positioned below the solar panel housing 514, and is in electrical connection with the battery 506. The lower surface of the light base 102 has one or more indentation housings 516 to accommodate the attachment bolts 306.

Figure 6:
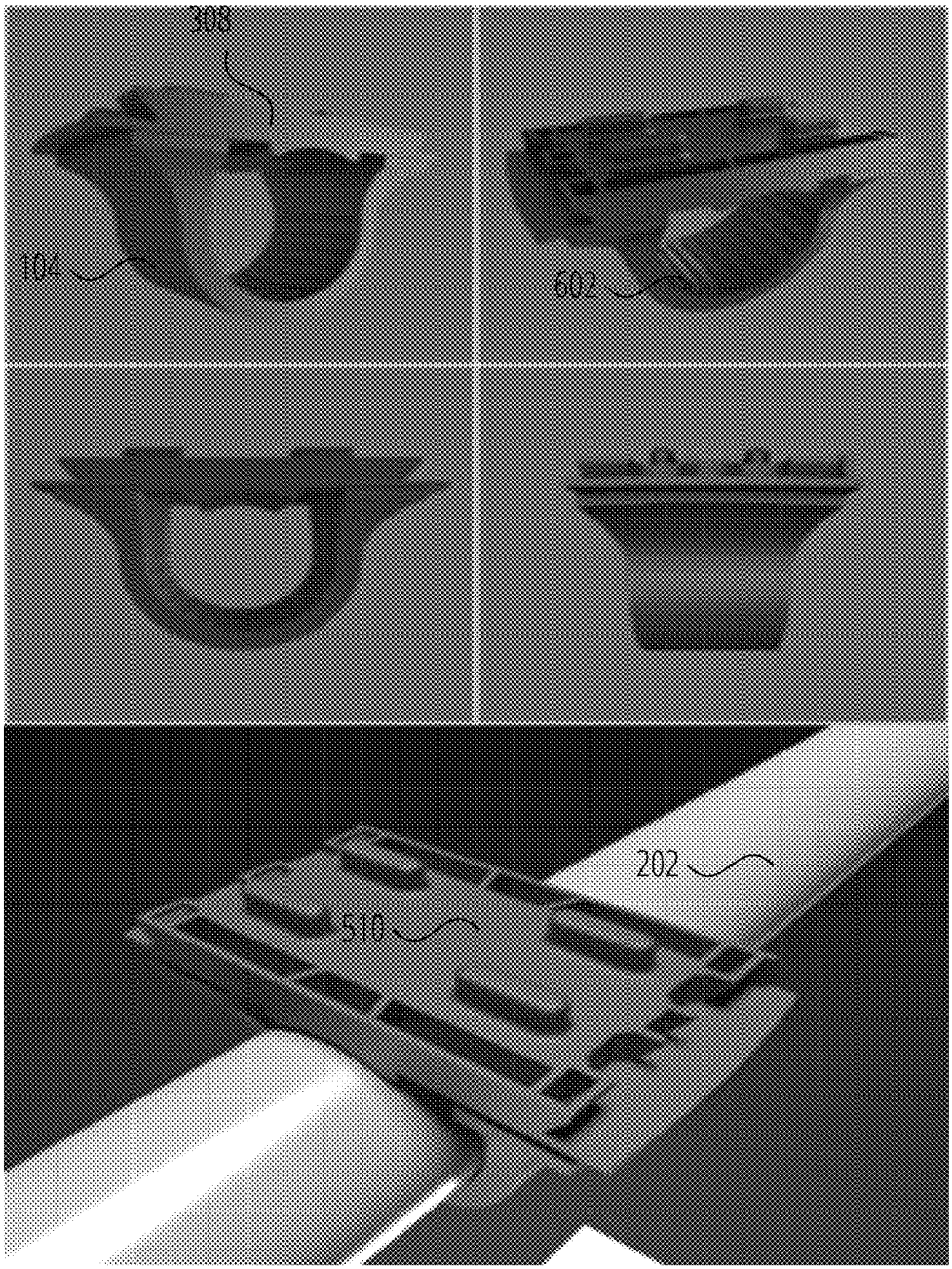
FIG. 6 illustrates various aspect of the bracket assembly in accordance with one embodiment of the invention.

FIG. 6 shows various different perspective views of the bracket assembly 118 in accordance with an embodiment of the invention. In one of the views, optional gripper elements 602 can be seen on the inner surface of the bracket 104.

Figure 7:
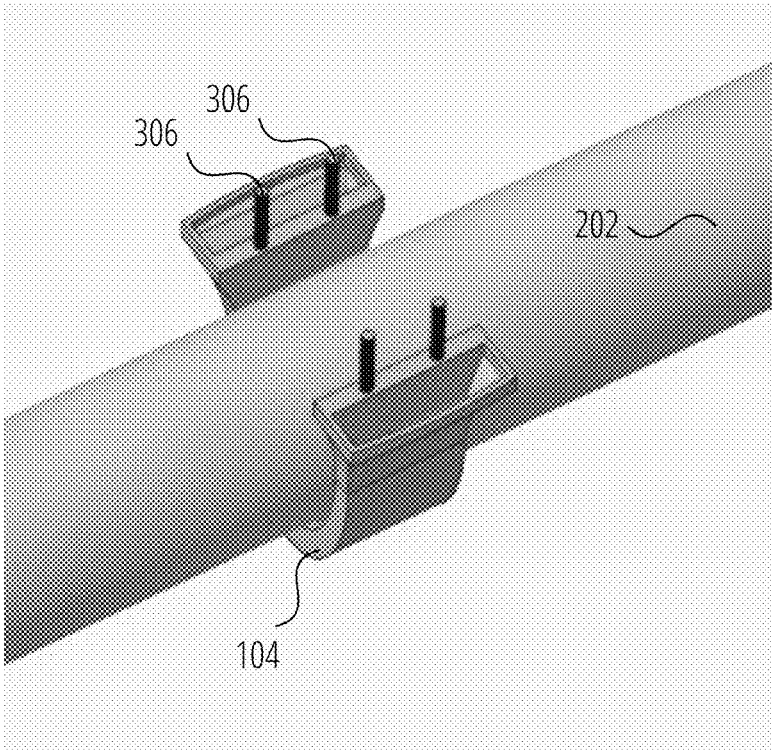
FIG. 7 illustrates an aspect of the lower part of the bracket assembly in accordance with one embodiment of the invention.

FIG. 7 shows a typical bracket 104 in accordance with an embodiment of the invention. The circumference of the bracket 104 is selected to correspond to the circumference of the pipe, rod or tube 202. The attachment bolts 306 can be seen protruding up from the base of the bracket 104.

Figure 8:
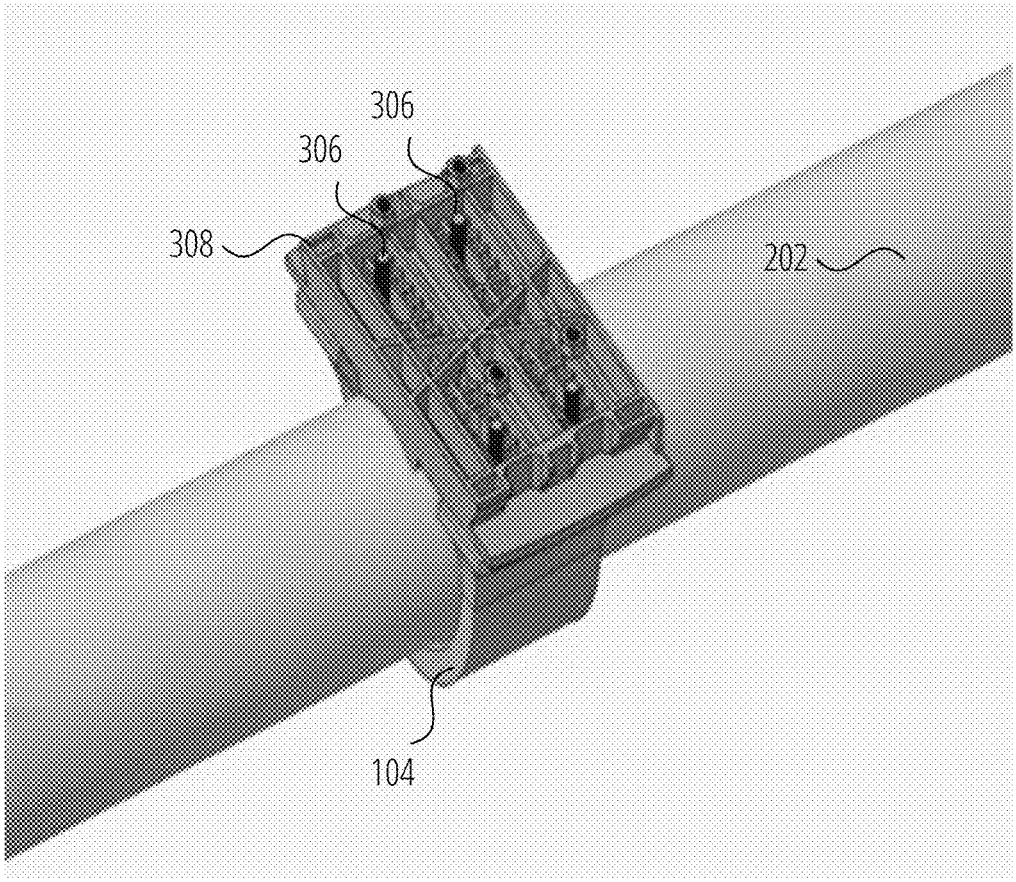
FIG. 8 illustrates an aspect of the lower and upper part of the bracket assembly in accordance with one embodiment of the invention.

FIG. 8 shows a typical bracket 104 and corresponding bracket base plate 308 in accordance with an embodiment of the invention. The bracket base plate 308 is positioned to correspond with the bracket 104.

Figure 9:
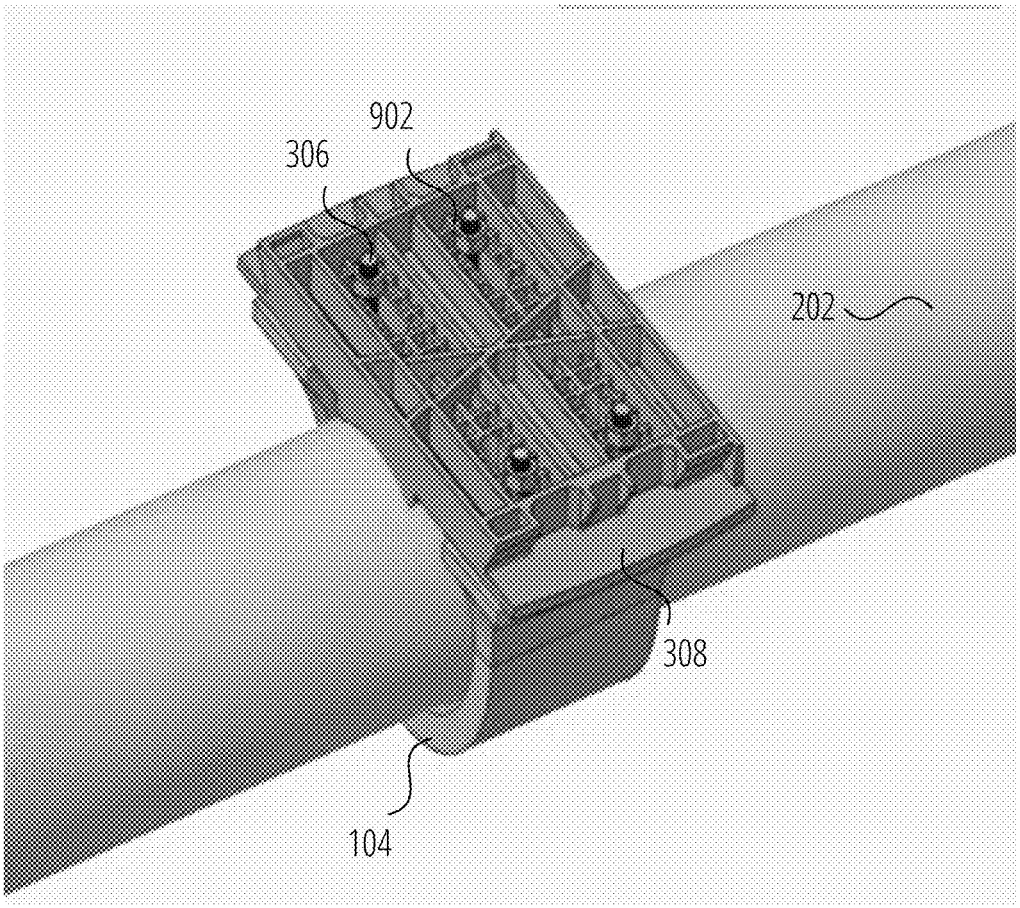
FIG. 9 illustrates an additional aspect of the lower and upper part of the bracket assembly in accordance with one embodiment of the invention.

FIG. 9 shows the securement of the bracket base plate 308 to the bracket 104 by means of the attachment nuts 902.

Figure 10:
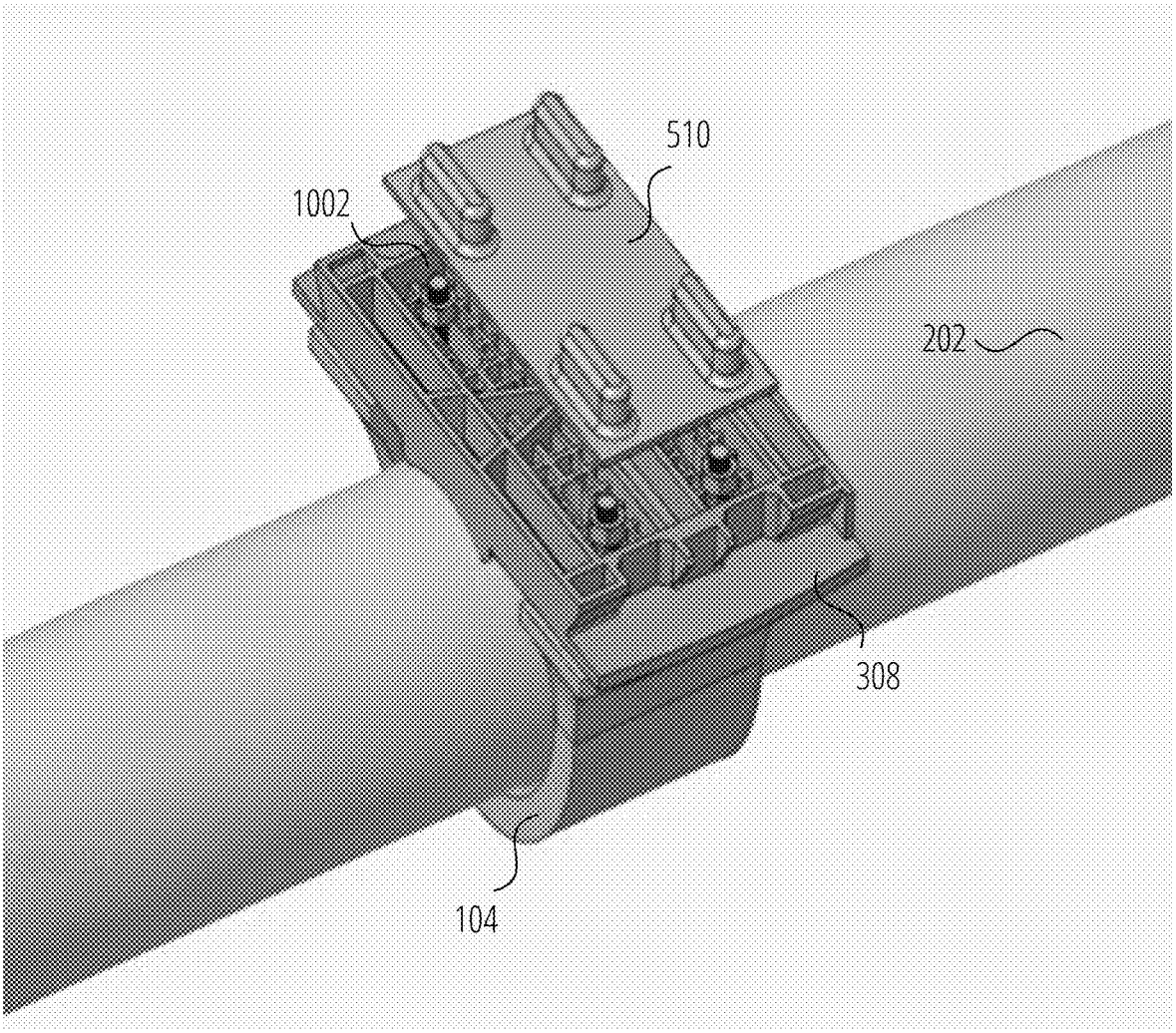
FIG. 10 illustrates an exploded view of the complete bracket assembly in accordance with one embodiment of the invention.

FIG. 10 shows the attachment nut and bolts 1002 beneath the plastic cover 510.

Figure 11:
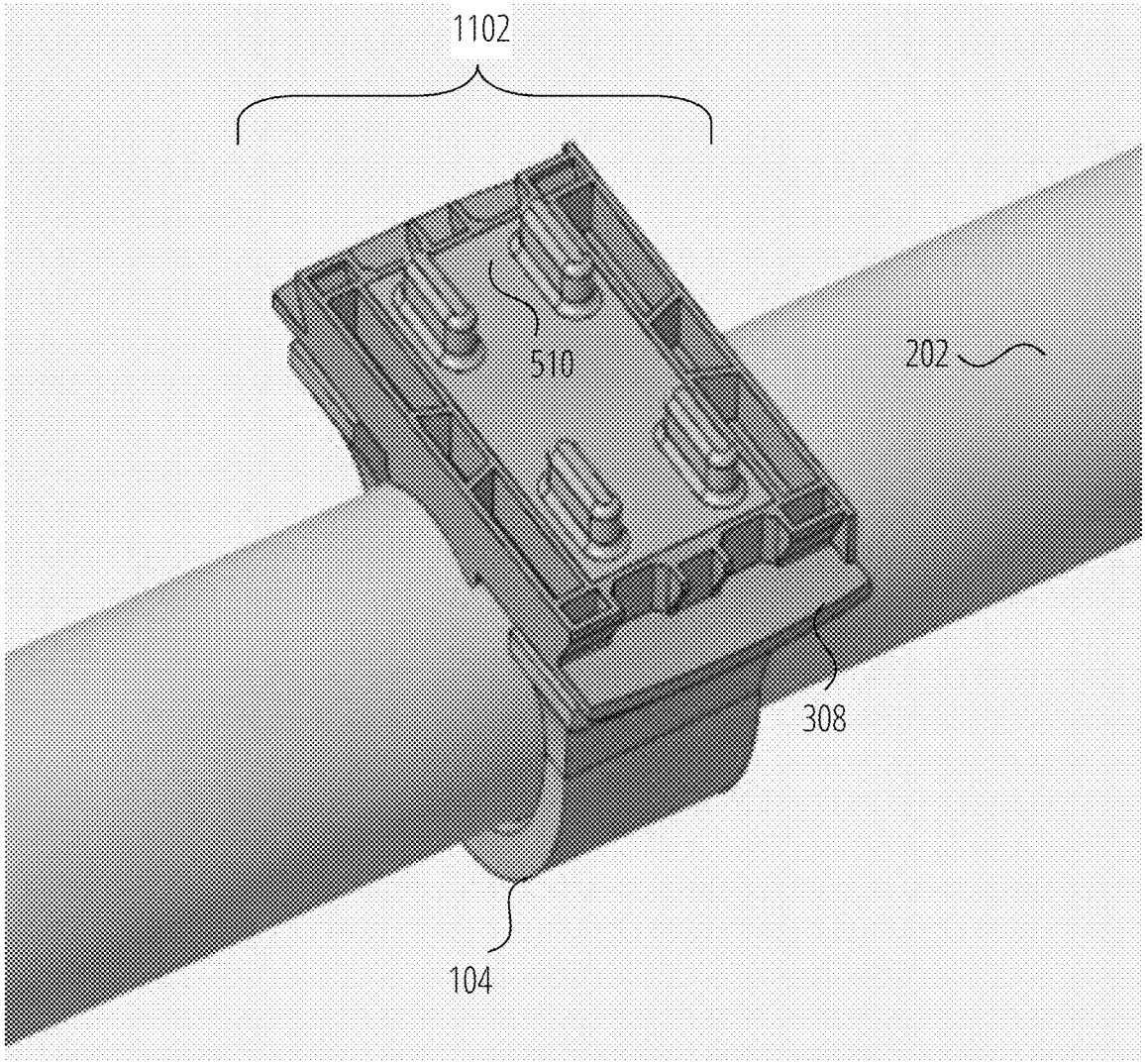
FIG. 11 illustrates a view of the complete bracket assembly in accordance with one embodiment of the invention.

FIG. 11 show the assembled mounting bracket 1102 in accordance with an embodiment of the invention.

Figure 12:
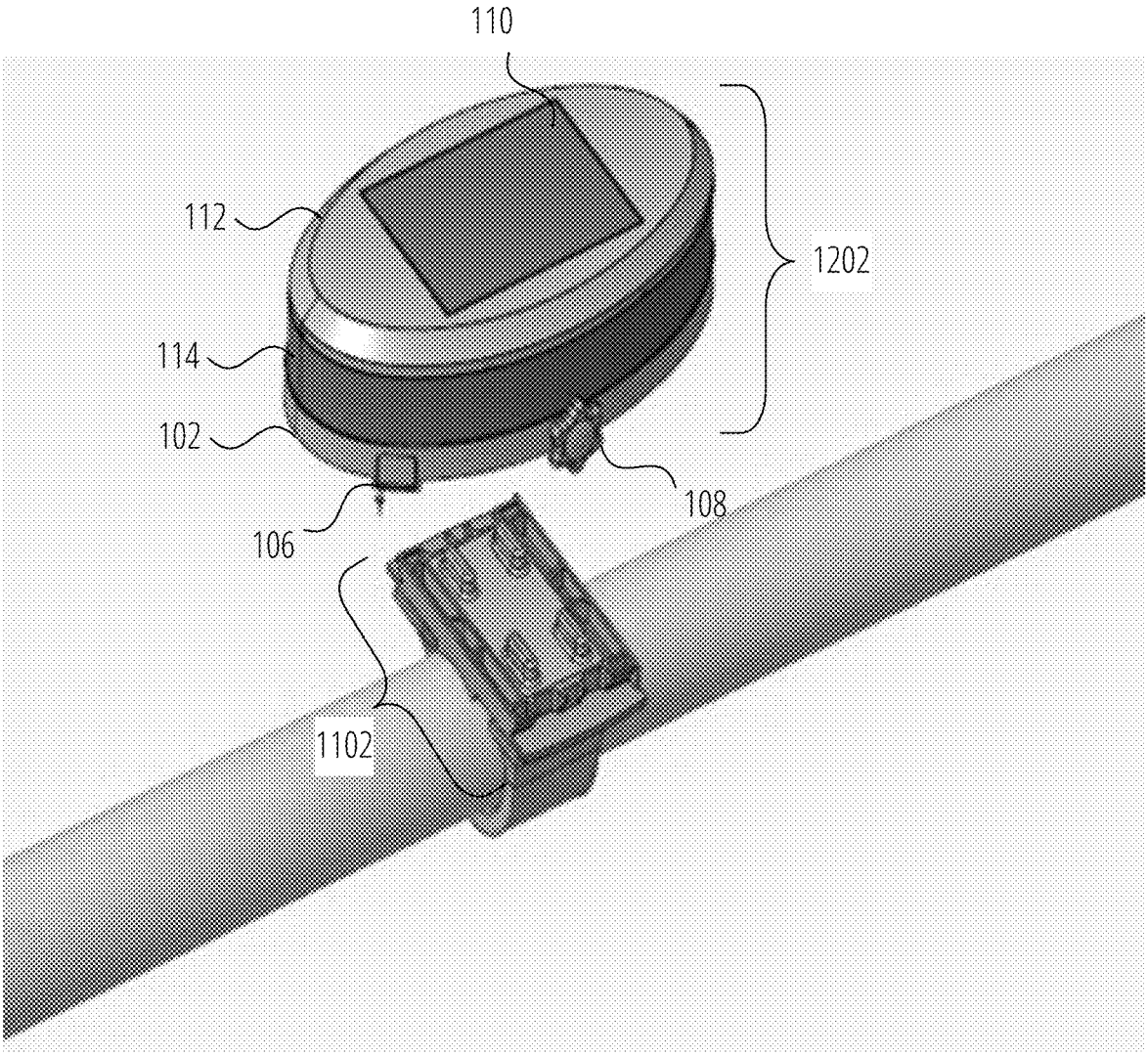
FIG. 12 illustrates the attachment of the light assembly to the bracket assembly in accordance with one embodiment of the invention.

FIG. 12 shows a perspective view of the assembled mounting bracket 1102 in position on the tube 202 and the unattached light 1202 prior to attachment to the assembled mounting bracket 1102.

Figure 13:
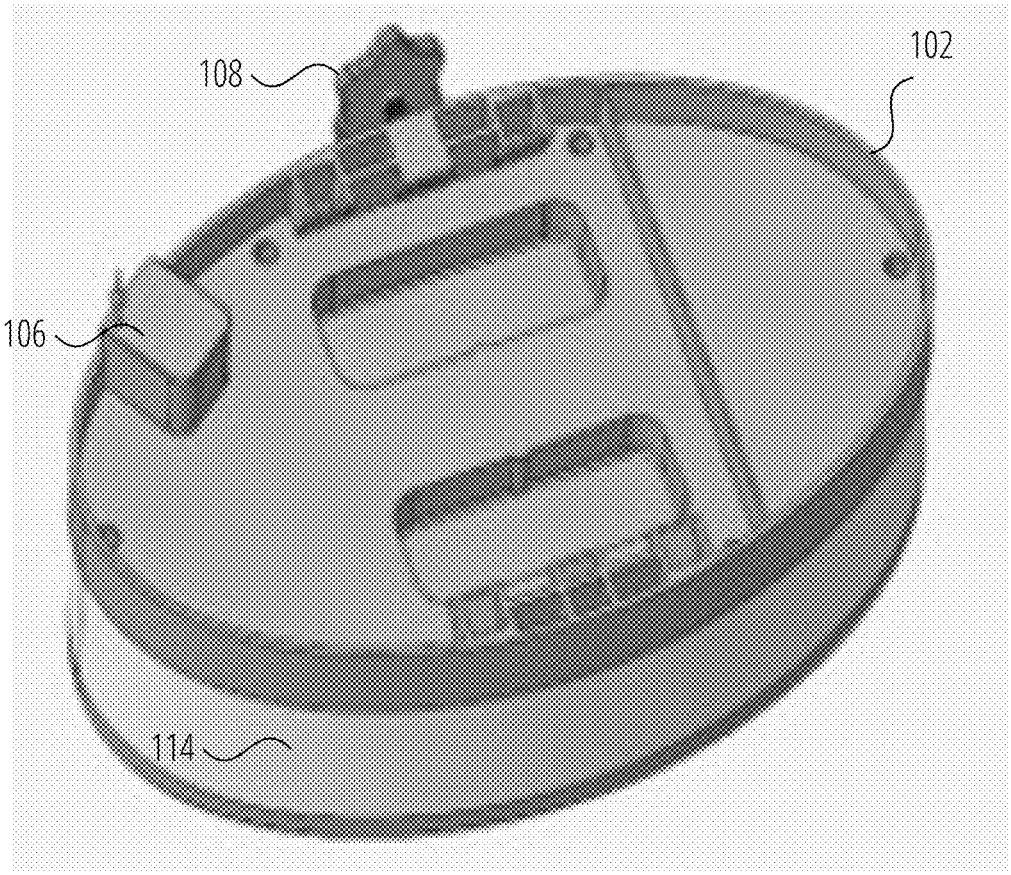
FIG. 13 illustrates a view of the underside of the light assembly in accordance with one embodiment of the invention.

FIG. 13 shows a perspective view of the underside of the light base 102 indicating the presence of the indentation housings 516, that are positioned to accommodate attachment nut and bolts 1002.

Figure 14:
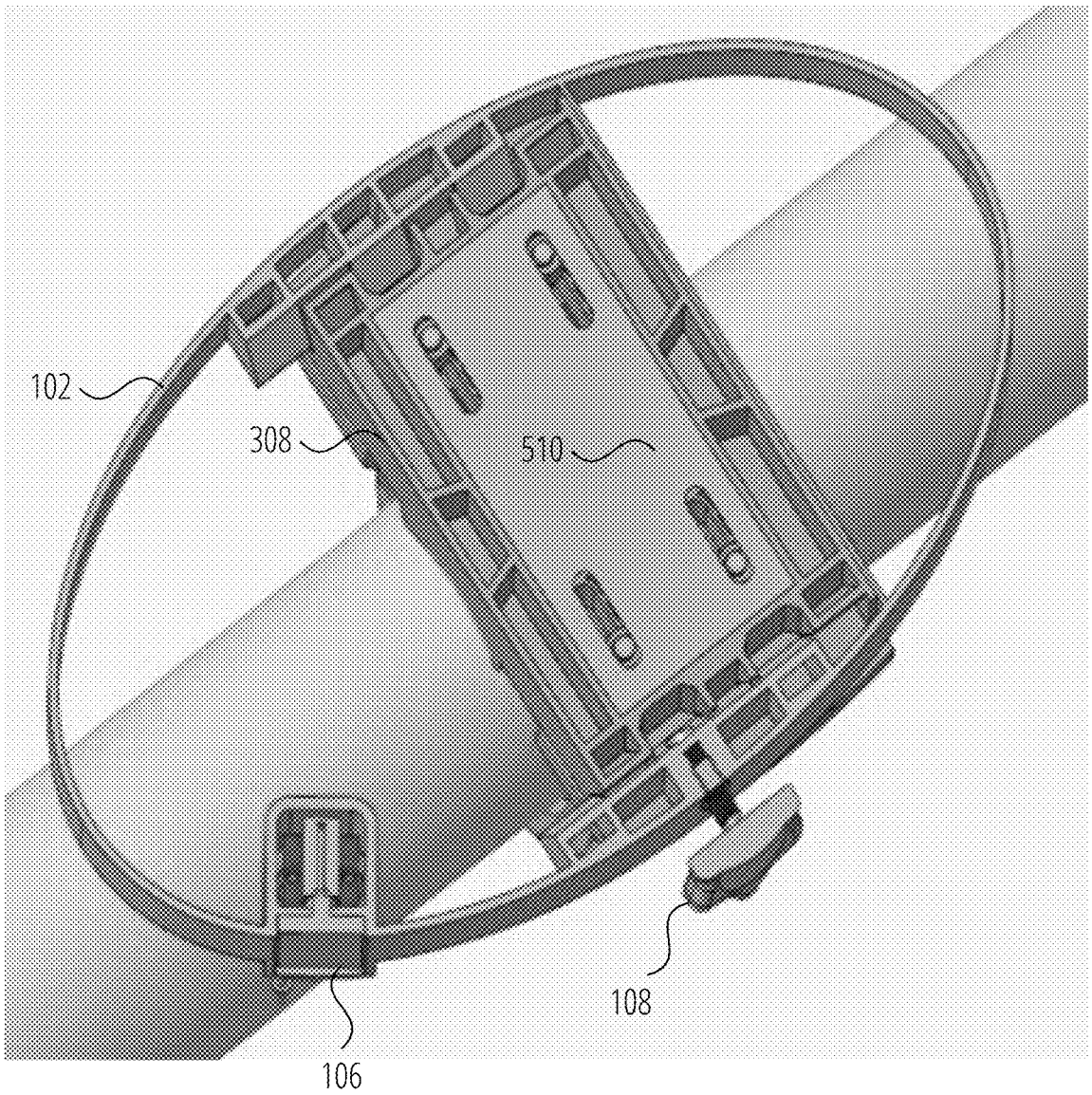
FIG. 14 illustrates a partial view of part of the base of the light and the bracket assembly in accordance with one embodiment of the invention.

FIG. 14 shows the first stage of attachment of the light assembly 116 to the bracket assembly 118. The light base 102 can be seen off-centered on the bracket base plate 308 and the locker screw 108 can be seen in its non-engaged position.

Figure 15:
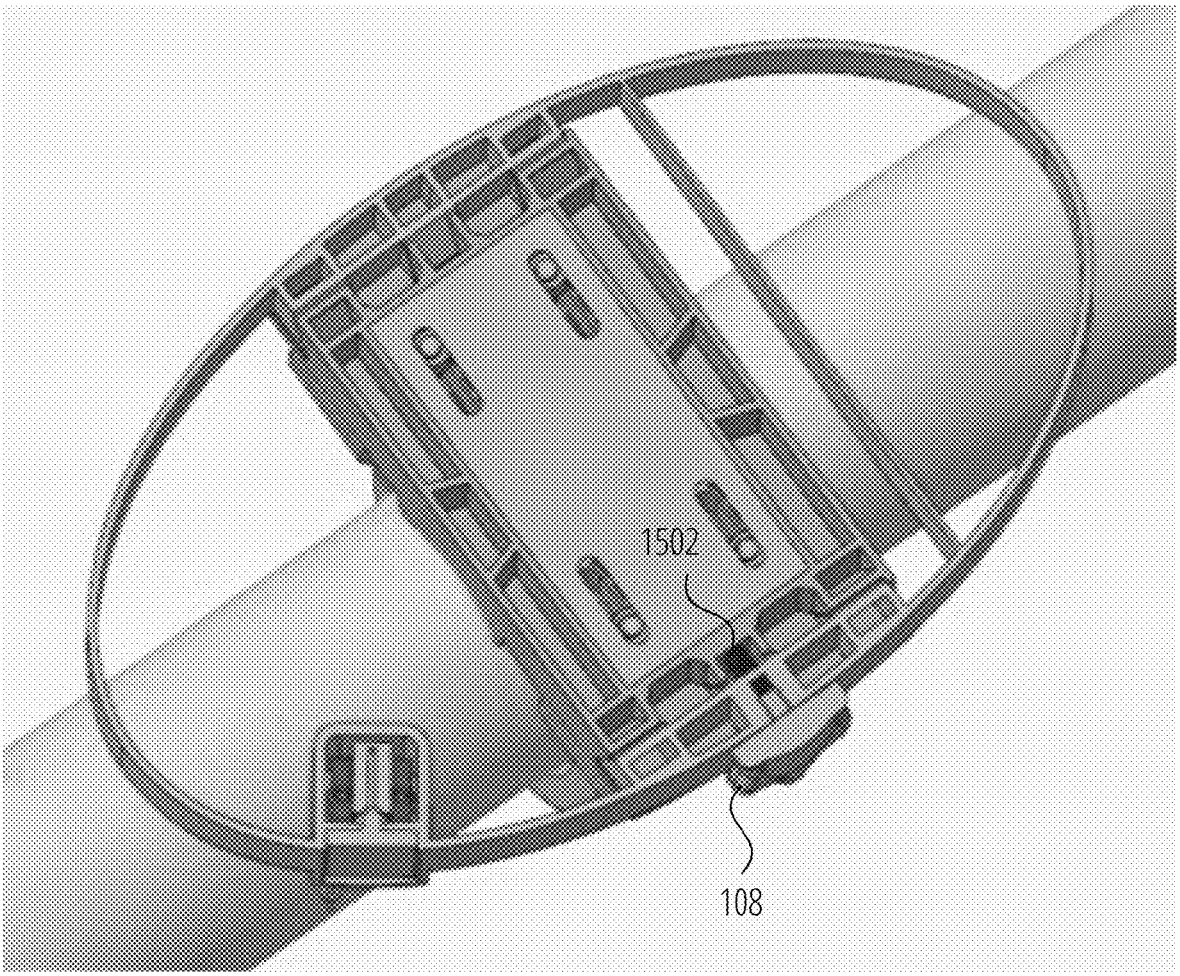
FIG. 15 illustrates a partial view of part of the base of the light and the bracket assembly in accordance with one embodiment of the invention.

FIG. 15 shows the second stage of attachment of the light assembly 116 to the bracket assembly 118. The light base 102 can be seen centered on the bracket base plate 308 and the locker screw 108 can be seen in its engaged position with the 108 extending into the locker screw port 1502.

Figure 16:
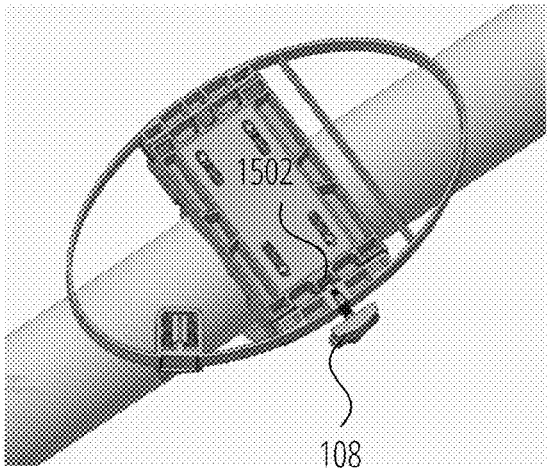
FIG. 16 illustrates perspective views showing the removal of the light assembly from the bracket assembly in accordance with one embodiment of the invention.
Figure 16:
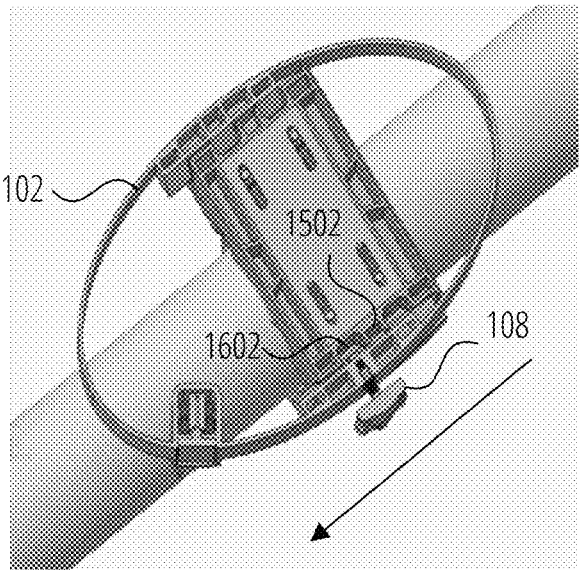
Figure 16:
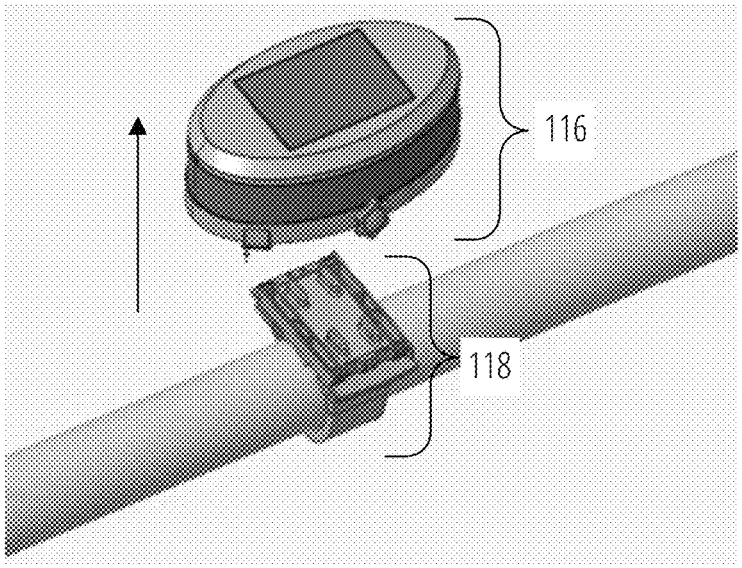

FIG. 16 shows the stages in the removal of the light assembly 116 from the bracket assembly 118. Step 1: The locker screw 108 is loosened from its locker screw port 1502. Step 2: The light base 102 is slid (as indicated) such that the locker screw 108 is released from the bayoneted locker screw port 1602. Step 3: The light assembly 116 can then be lifted up (as indicated) and off of the bracket assembly 118.

Figure 17:
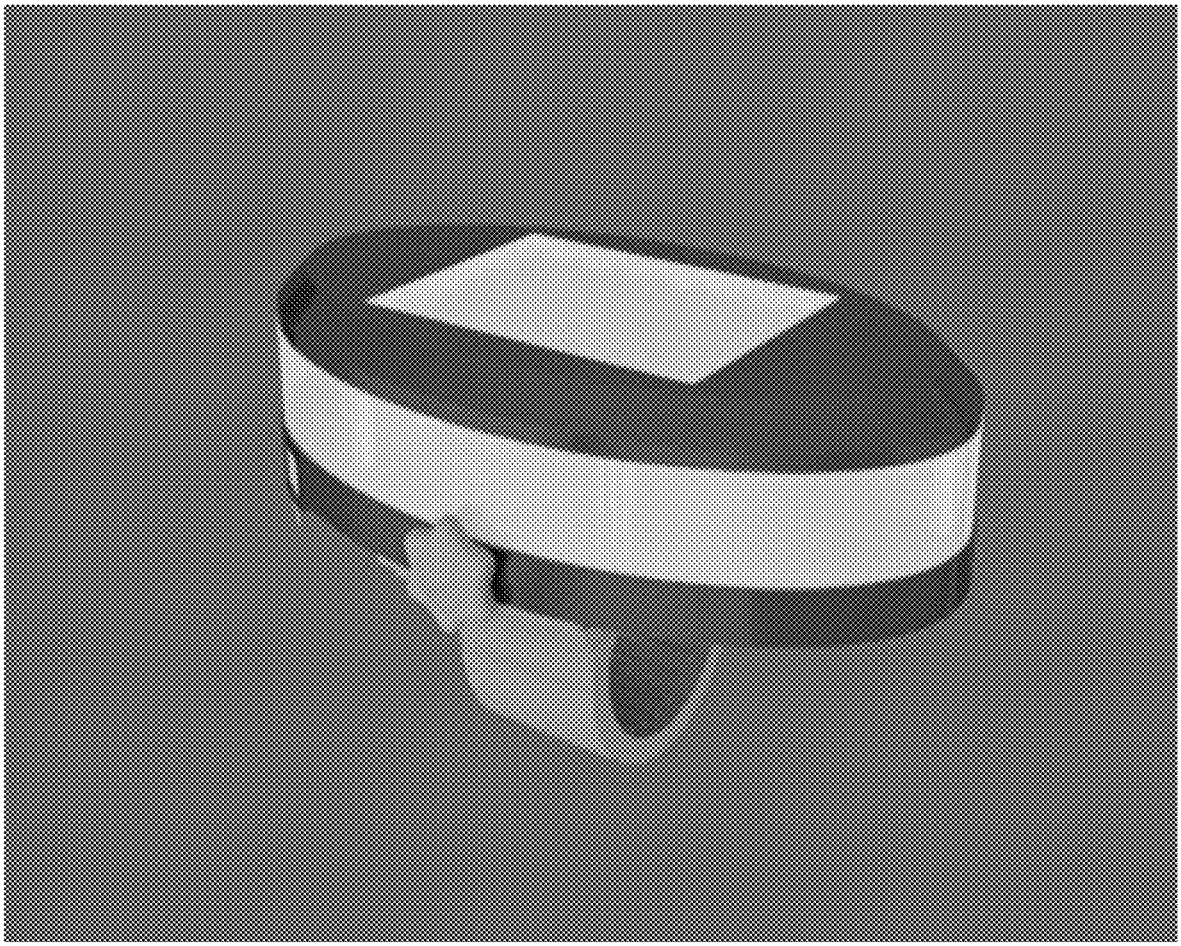
FIG. 17 illustrates a perspective view showing the complete light and bracket assembly in accordance with one embodiment of the invention.

FIG. 17 illustrates a boat safety light in accordance with an embodiment of the invention.

There are numerous ways in which the light can be activated. For example, when the boat is towing a skier, wakeboarder etc. and they release the rope the system a spotter in the boat can activate the light and/or a system of lights to provide warning other boaters.

In other embodiments of the invention, activation of the light may be achieved via remote control. The remote control can be a remote switch or by voice activation via Bluetooth. Activation of the light can also be achieved manually via a physical switch by operator in the boat, or the spotter.

The light is typically configured to flash orange/red/amber LED light, although any color of light is within the scope of protection sought. The light may emit an assortment of colors, and patterns including but not limited to strobe or flash. The light may be attached to a rod, bar or tube on the boat. It is recommended to install the light at a high point on the boat, such as the tower, to achieve maximum visibility. The LED light assembly 116 is waterproof, and is great for night boating and for signaling to other boaters.

The system may be solar powered or battery powered. Some embodiments of the invention may have a power supply in addition to or in place of the solar panel 110. The additional power supply is typically provided from the boat battery. Such an additional power supply, to the LED light or to the rechargeable battery 506 in the light assembly 116, may be provided via charging port 106 with a variety of charger fittings such as a USB port.

The light is powered by a rechargeable battery, and typically can continue work for 4~5 hours. The battery can be charged by a power supply or solar panel. The light can easily be removed and taken home for charging, or you can connect the light to the power supply on the boat by a connection cable.

In an additional embodiment, this system may be connected to an existing lighting and existing power supply within a boat (existing wiring). It is envisioned that some installations may be factory-fitted into boats during manufacture.

With regard to the bracket assembly 118, it is envisaged that the bracket base plate 308 is made from a hard plastic, and the bracket 104 from a stainless rod covered by soft plastic, with optional gripper elements 602.

Boaters have more hazards these days with wake boats, ski boats jet skis, paddle boards etc. on the water. People need a warning system to know when people are in the water, be they swimmers or skiers, wakeboarders or divers, or in the event of emergencies, such as but not limited to running out of fuel or engine failure. When you are towing a person and they fall or let go of the tow rope the system deploys and the flashing warning lights alert others of potential hazards. It gives a boater extra protection and peace of mind knowing that every other boater in the area knows of the situation and to take extra caution when deployed.

The foregoing descriptions of specific embodiments of the present invention have been presented for purposes of illustration and description. They are not intended to be exhaustive or to limit the invention and method of use to the precise forms disclosed. Obviously, many modifications and variations are possible in light of the above teaching. The embodiments described were chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

The invention claimed is:

1. A boat safety warning device, comprising:

a bracket assembly configured to be affixed to boat, said bracket assembly having a rotational member for allowing three-dimensional rotation and adjustment and an external charging port;

a light assembly comprising a housing, having a translucent section supporting an upper surface of said housing, said translucent section secured to said housing via an O-ring, said housing configured to be attached to said bracket assembly, said housing containing a waterproof LED light and an LED printed circuit board wherein said LED printed circuit board is configured to cause the LED light to produce an orange or red strobe lighting effect;

a rechargeable battery in electrical connection with said LED light and said external charging port;

a solar panel mounted on said upper surface of said housing, said solar panel being in electrical connection with said rechargeable battery; and a switch selected from the group consisting of: a manual switch; a tension switch; a remote switch; and a Bluetooth switch, which when activated allows power to be supplied from said source to said LED light.

2. The boat safety warning system of claim 1, wherein a boat battery is in electrical connection with said LED light.

3. The boat safety warning system of claim 1, wherein said LED printed circuit board is alternatively configured to cause the LED light to produce a continuous light or a flashing light sequence.

4. A boat safety signaling kit, comprising:

a bracket assembly consisting of a bracket, a bracket base plate, attachment means and a rotational member for allowing three-dimensional rotation and adjustment and an external charging port;

a light assembly configured to be attached to said bracket assembly, said light assembly consisting of a housing, having a translucent section supporting an upper surface of said housing, said translucent section secured to said housing via an O-ring, a waterproof LED light, an LED printed circuit board wherein said LED printed circuit board is configured to cause the LED light to produce an orange or red strobe lighting effect;

a rechargeable battery in electrical connection with said LED light and said external charging port;

a solar panel mounted on said upper surface of said housing, said solar panel being in electrical connection with said rechargeable battery; and a switch selected from the group consisting of: a manual switch; a tension switch; a remote switch; and a Bluetooth switch, which, when activated, allows power to be supplied from said rechargeable battery to said LED light.

5. The boat safety signaling kit of claim 4, wherein a boat battery is in electrical connection with said LED light.

* * * * *